United States Patent [19]

Zhong et al.

[11] Patent Number: 4,990,068

[45] Date of Patent: Feb. 5, 1991

[54] UNIQUE GREASE LUBRICATED BALL BEARING CANNED MOTOR PUMP

[76] Inventors: Xing X. Zhong; Yu Z. Zhao, both of No. 1, Ma Shen Miao, Hai Dian District, Beijing, China

[21] Appl. No.: 170,274

[22] Filed: Mar. 18, 1988

[30] Foreign Application Priority Data

Mar. 23, 1987 [CN] China ..... 87102185

[51] Int. Cl.[5] ..... F04B 39/06

[52] U.S. Cl. ..... 417/423.8; 417/423.12; 417/372

[58] Field of Search ..... 417/423.6, 423.7, 423.8, 417/423.11, 423.12, 423.13, 367, 372

[56] References Cited

U.S. PATENT DOCUMENTS

| | | | |
|---|---|---|---|
| 2,830,541 | 4/1958 | Higgins et al. | 417/423.12 |
| 3,163,999 | 1/1965 | Ditzler et al. | 417/423.13 |
| 3,796,526 | 3/1974 | Cauley | 417/423.13 |
| 4,115,038 | 9/1978 | Litzenberg | 417/423.12 |

FOREIGN PATENT DOCUMENTS

| | | | |
|---|---|---|---|
| 46-28942 | 9/1971 | Japan | 417/423.11 |
| 0178013 | 1/1966 | U.S.S.R. | 417/423.13 |

*Primary Examiner*—Leonard E. Smith
*Assistant Examiner*—Robert N. Blackman
*Attorney, Agent, or Firm*—Rines and Rines

[57] ABSTRACT

The present invention relates to a sealed centrifugal pump used for delivering special liquids and that overcomes the limitations of well-known canned or sealed motor pumps, including relatively short service life of the bearings and unsuitability for delivering liquids or fluids containing tiny particles or contaminents by means of a new type of structure in which the bearings, which are working in liquid phase, are isolated from the pumped fluid medium. This enables ball bearings to be used as the support of the canned motor, the use of lubricating oil and grease for the ball bearings, and the forced cooling of the lubricant and bearings other than by the pumped fluid, so that the service life of the whole pump unit has been increased, and the delivery of liquids containing tiny particles is enabled.

13 Claims, 2 Drawing Sheets

UNIQUE GREASE LUBRICATED BALL BEARING CANNED MOTOR PUMP

The present invention relates to fixed capacity pumps used for delivering special liquids or fluid media; being more particularly directed to so-called "canned" motor pumps also known as sealed pumps of a particular centrifugal type, wherein the motor is integrated with the pump and the rotor and stator of the motor are enclosed within non-magnetic corrosion-resistant metallic thin cans, with appropriate sealing and welding such that the rotor is totally immersed in the fluid medium, providing a fully closed structure obviating the need for external rotary sealing.

BACKGROUND

There are many kinds of such canned or sealed fluid motor pumps in the world including, for example, the canned motor pump made by Japan Machinery & Instrumentation Co. Ltd. and the canned motor pump disclosed by the U.S. Pat. No. 4,115,038. Much of the literature published in China and foreign countries, while praising the achievement in canned motor pumps, has frequently pointed out the problems needing further improvement.

First, the non-oil-lubricated graphite surfaces generally used in such canned motor pumps as bearings and shaft sleeves are key components, because the wear of bearings will damage their clearance and result in collision of the rotor with the stator that shortens the service life of the pump. Owing to the fact that the bearing of the canned motor pump must be immersed in the fluid medium to be pumped, lubricating oil and lubricating grease can not be applied, so that the lubrication and cooling must be accomplished by the internal circulation of the fluid medium only. However, not all the fluid media that are to be pumped have lubricating properties. To the contrary, many such media possess chemical corrosion properties. Furthermore, the circulating feature of the cooling fluid subjects the bearings to axial thrust; such factors requiring consideration of special bearing materials. At present, graphite and stack welding Co-Cr-W alloy are the generally adopted friction bearing surfaces in all countries. Graphite bearings, however, have small compressive resistance and are strongly affected by the properties and temperature, etc., of the fluid media. In particular, the lubrication of the bearings is affected by the fluid medium itself rather than oil or grease. Therefore, the problem of bearing service life is an urgent problem requiring solution (cf. "Atomic Energy Industry", p399, Atomic Energy Press, China, 1978; "Pipes Arrangement Technology", Japan, 1969, Vol. 11, No. 7).

Secondly, since the bearings of such well-known canned motor pumps are all immersed in the fluid medium, there is a stringent demand on the cleanliness of the medium to be pumped, so that the pump can not be effectively used for delivering fluid media containing tiny suspended particles, limiting the application range of such canned motor pumps ("Power" 1966, V. 110, No. 9).

Thirdly, such canned motor pumps by their design require such accessories as filters, air vent valves and bearing wear-monitors, etc.

OBJECT OF INVENTION

In view of the above and other shortcomings of the sealed or canned motor pumps, the present invention has as its object the providing of a new type of canned or sealed centrifugal motor pump of improved and longer service life than that of existing canned motor pumps, and that, unlike current pumps, is able to deliver fluid media containing tiny suspended particles and is convenient for operation and manufacture.

SUMMARY

In accordance with the present invention, the motor bearings of the centrifugal pump are isolated from the pump casing and do not contact the liquid or fluid medium to be delivered and are enabled to obtain full lubrication and long service life. Through this solution of the above problems by isolating the bearings from the delivered liquid, and doing so in a leak-proof manner, the advantages of the canned motor pump are combined with those of the centrifugal pump, and the object mentioned above is achieved.

Specifically, the invention employs within the pump case an impeller, stator and hollow rotor, wherein the stator and rotor are isolated from the pumped fluid medium by using non-magnetic corrosion resistant metallic shieldcans, including a cup mounted on the upper end of the stator in an inverted position on top of the hollow rotor through a coaxial three-tube vertical shaft. The said hollow rotor has an open upper end and a closed lower end and is supported at its ends by pairs of ball bearings, the inside races of which engage the vertical shaft, and the outside races, the inner walls of the rotor at its respective ends. The said coaxial three-tube vertical shaft comprises three coaxial tubes, the innermost tube of which is connectable at its upper end with the atmosphere and at its lower end with the bearing chamber or cavity formed between the coaxial three-tube vertical shaft and the hollow rotor. The middle tube and the outer tube connect to a water inlet and outlet, respectively. At least one throttle hole is provided between a rear sealing ring of the pump and the motor stator chamber, with a fluid return tube provided between the before-mentioned cup and the suction inlet of the pump.

The canned motor pump developed in accordance with this design realizes the isolation of the bearings from contact with the fluid medium being pumped. It enables desirable roller bearings to be used as the supporting elements of the motor rotor and the isolated use of lubricating oil and lubricating grease for the roller bearings. It also provides forced cooling for lubricant and bearings. Further detailed explanation will now be provided with reference to the following accompanying drawings.

DRAWINGS

DESCRIPTION OF INVENTION

Figure 1:
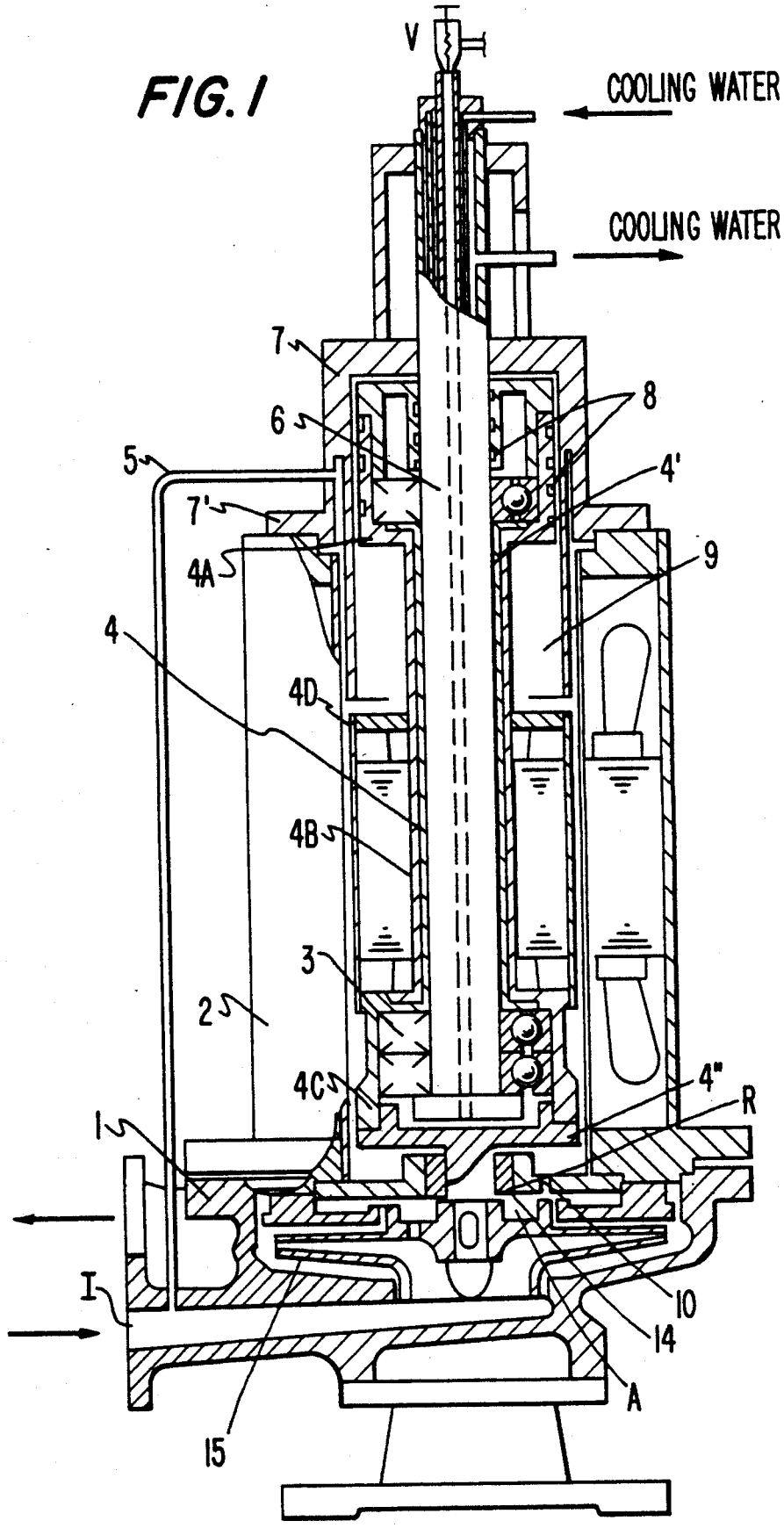
FIG. 1 is a schematic longitudinal section diagram of the oil lubricated ball-bearing canned motor pump of the present invention.

It will be seen from FIG. 1 that the present invention maintains the advantage of integrating the pump casing (1) and bottom impeller (15) with the motor, the stator of which is shown at (2), surrounding the coaxially mounted hollow rotor (4). An inverted cup (7) is mounted through a flange 7' on the upper end of the stator (2). The upper end of the hollow rotor (4) is open (4') and the lower end (4") is capped or closed adjacent the fluid pumper impeller (15). The rotor (4) is mounted on the coaxial three-tube vertical shaft (6) which, in turn, is welded with the cup (7). Upper and lower enlarged diameter bearing chambers (4A and 4C) are formed in the rotor end regions abutting the coaxial three-tube vertical shaft (6) with at least two pairs or sets of ball bearings (3) mounted inside the respective bearing chambers. According to the chemical properties of the fluid medium, bearingsteel bearings, stainless-steel bearings and acidresistant alloy steel bearings may be chosen. The bearing chambers (4A, 4C) also provide a cavity for storing lubricating oil or grease. Such lubricating oil or grease is prevented from leaking through the upper opening (4')of the rotor (4) by spiral inner and outer seals (8) between the relative moving surfaces of the upper-end inner wall at the opening of the hollow rotor (4) and the coaxial threetube vertical shaft. A pumping pressure head of the viscous liquid in the sealed clearance will be created by the spiral, thus preventing the oil or grease from leaking upward.

An air chamber (9) is formed between the cup (7) and the hollow rotor (4), which prevents the small portion of the main pumped fluid flow which is flowing through the stator chamber, from entering the cavity-type bearing chamber (4A) by an air-cushion seal, while directing such flow to return to the suction inlet (I) of the pump through the flow-return tube (5). Further to prevent splashing liquid from entering the upper bearing chamber (4A) the before-mentioned outer spiral seal (8) is disposed between the outer cylindrical surface of the upper part (4A) of the hollow rotor (4) and the inner wall of the cup (7).

In order to ensure the reliability of the air sealing, it is necessary to control the pressure in so far as possible. As is well-known, the dissolution of a gas in liquid is a function of the properties of the liquid itself, and, in addition, it is directly proportional to the pressure at the air sealing point. The pumped liquid, which gains energy from the before-mentioned impeller (15), is of positive pressure. A small portion of the same leaks at the bottom packing gland or sealing ring (R) of the pump to the chamber A, and is retarded by the shaft sleeve (14) which acts as an auxiliary support for centering. Most of the liquid flows back through the balance hole of the impeller (15), a small portion of it being used for cooling the motor by entering into the stator chamber of the motor through at least one throttle hole (10) of appropriate size, under the force of the negative pressure provided at the suction inlet (I) of the pump. Thus, a pressure at the air sealing point which is almost equal to the outside atmosphere is obtained. The flow-return tube (5) is provided externally of the cup (7) to (I), with its upper end connected with the rotor chamber through the cylindrical clearance outside the cup (7), and its lower other end connected to the negative pressure area at the suction inlet (I) of the pump.

Figure 2:
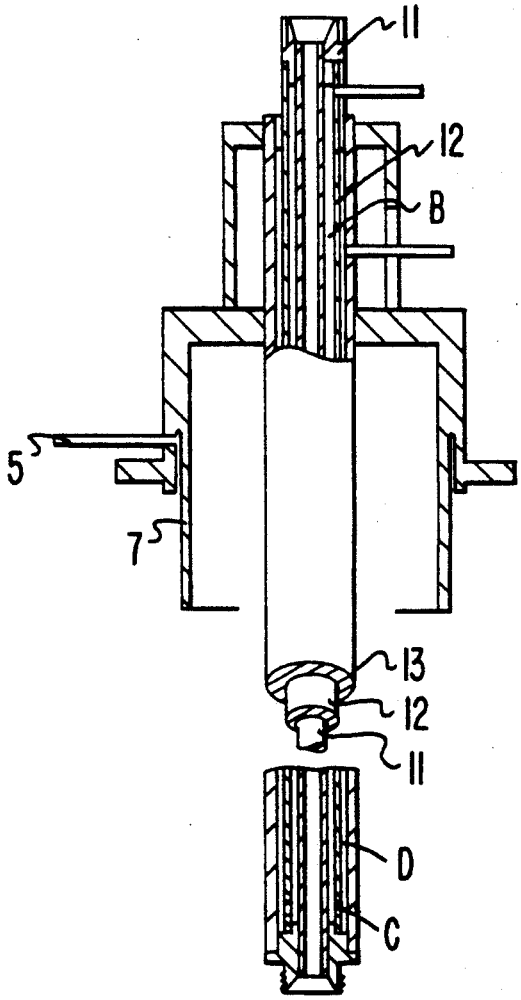
FIG. 2 is a similar diagram showing the details of the coaxial three-tube vertical shaft with its air chambers.

The said coaxial three-tube vertical shaft (6) is made up of an innermost tube (11), an intermediate or middle tube (12) and an outer tube (13) which are of successive coaxial assembly, the same being welded with a stopper the two end faces of which are machined to serve as coaxial stepping shoulders (FIG. 2). The roles served by these tubes are as follows: The outer tube (13) is used for supporting the hollow rotor (4) and for fixing the inverted cup (7). The middle tube (12) is used, along with the inner tube (11) and the outer tube (13), respectively, for forming chambers B and D. Cooling water is flowed into chamber B, through the hole C at the lower part of the middle tube (12), as shown in FIG. 2, proceeding towards the chamber D, providing cooling for the upper and lower bearing chambers (4A and 4C). The upper end of the inner tube (11) is connected to the outside atmosphere, and the lower end connects to the lower bearing chamber (4C) between the vertical shaft (6) and the lower end of the hollow rotor (4). Lubricating oil is filled into the inner tube 11 during the installation of the pump and before starting. When thin oil lubrication is used, the tube (11) may also serve for oil level checking and new oil refilling without dismantling the pump. In order to further prevent the air seal failure, an angle valve or electro-magnetic valve (V) is mounted on the upper end connected to the atmosphere, if necessary, and connected to an air storage tank, so that the valve can be used for controlling the air, refilling periodically and monitoring by a pressure gauge mounted thereat and adjusting the pressure at the air sealing point of the stator chamber.

The present invention may be readily used by factories with the capability of making canned motors and making centrifugal pumps without the need of special equipment. The making of the motor consists of the following components: 1. in the stator component, a corrosion-resistant metallic thin can must be used to prevent the motor winding from being corroded by the chemical fluid medium; 2. the coaxial three-tube vertical shaft is a welded component shown in FIG. 2 in which the main fitting dimensions are all processed after welding; 3. in the rotor components, the bearings are mounted at the two ends of the finished rotor and the rotor is pressed on to the coaxial three-tube vertical shaft, fixing the impeller shaft with a flange at the lower end of the rotor and thereby forming bearing chambers, with an upper end that is open and lower end that is closed. Two further points should be noted when using the present invention. First, the pump should preferably be installed vertically; and secondly, particularly when thin oil is adopted for lubrication, the upper end of the innermost tube of the vertical shaft should be opened after pump installation and before liquid filling, so as to enable filling the inner tube with the lubricating oil, before closing off the upper end.

Compared with the present-day non-oil-lubricated sliding bearing canned motor pumps, the oil lubricated ball bearing canned motor pump of the invention has the following advantages:

1. It combines the advantages of absolutely leakproof canned motor pumps with the long service life feature of the bearings used in centrifugal pump; replacing sliding bearings with rolling bearings, replacing non-oil-grease lubrication with oil-grease lubrication and increasing the service life of the pump.

2. Forced cooling of the ball bearings is achieved independently of the pumped fluid, ensuring good lubricating effects.

3. The ability to use ball bearings provides the advantages of small clearance, good centering performance, less wear, prevention of rotor rotating axis deviation and resulting collision with the stator and consequent damage to the motor which would otherwise occur due to the wear of the bearings.

4. Providing a pump that can readily deliver fluid media containing tiny suspended particles.

5. The pressure in the motor chamber may be as low as near atmospheric pressure, so that the axial thrust in the pump is reduced.

6. Totally eliminating the need for such accessories as filters, air vent valves or bearing wear monitors, etc. which the current well known canned motor pumps must employ.

By way of recapitulation and summary, these types of fluid flow occur in the pump of the invention:

(A) The main fluid flow is the pumped fluid medium, which is sucked into the pump from the inlet (I) and is pumped out through the outlet.

(B) A small portion of this fluid medium flows upward through orifice (10), FIG. 1, into the clearance formed between the rotor (4) and the stator (2) towards the cup (7). It is prevented by air-cushion sealing at (9) from entering the bearing chamber (4A) since the inverted cup (7) serves as an air chamber, and the fluid is forced to flow back to the suction inlet (I) of the pump through the flow-return tube 5. The function of this fluid path is for cooling the motor while isolating the rotor bearings from contact with the pumped fluid.

(C) Cooling water is the third type of fluid circulation. It is fed in at the upper end of the intermediate tube 12 (FIGS. 1 and 2) and drained off at the upper end of the outer tube 13. Its function is for cooling the bearings; and the cooling water neither mixes with the transferred fluid medium nor contacts the lubricant in the bearing cavities. It is supplied by the independent water source with the vertical shaft (6).

Thus, the invention provides a novel sealed bearing centrifugal pump in which there is:

a hermetic seal between the fluid being pumped and the ball bearings at the upper end of the pump rotor, and a tight seal between the ball bearing at the lower end of the rotor and the suction side of the pump.

To achieve this, the "inside" races of all ball bearings are supported by the fixed vertical shaft or arbor (6), while the outside races support the cylindrical and hollow rotor assembly (4). The pump (or lower) end of the rotor is closed by the cap (4") which centrally carries a shaft (14), snugly fitted in a packing gland (R) and in turn carrying the centrifugal pump impeller (15) on an extension of this shaft.

Fluid which leaks past the packing gland is removed by the tube or pipe (5) which is connected back to the suction part (I) of the pump. Lubricant for the bottom and top ball bearings and for the further tight sleeve bearings at the top of the rotor is supplied under pressure through the innermost tube in the shaft or arbor. Concentric channels around this tube supply coolant to the rotor. Any lubricant which leaks around the tight sleeve bearing will be sucked up by the flow-back suction pipe (5).

In order to accommodate the lamination of the rotor, the diameter of the hollow part thereof is shown reduced at 4B in the area between the ball bearings. The laminations of the rotor are sealed in a non-magnetic metal "can" which extends from the lower rotor assembly (4C) to the intermediate flange (4D) which, in turn, is attached to the hollow rotor.

The shaft or arbor (6) is rigidly attached to the inverted cup structure (7) which is mounted on the housing containing the stator of the pump. The flow of the pump can be controlled by one or more flow-throttling nozzles (10).

The advantage of this type of pump is that the fluid being pumped does not come in contact with the ball bearings of the pump, which are independently maintained oil lubricated. Thus corrosive fluids or fluids which contain small solid particles can not damage the pump bearings. The result is that a much longer period between overhauls is required.

The canned motor pump developed in accordance with the present invention can be used for delivering liquids with radioactivity, corrosiveness, poisonousness, inflammability and explosiveness. Liquids that pollute the environment can be safely pumped, and the pumps of the invention are widely applicable for use in the nuclear industry, in aerospace, in chemical engineering, petrochemistry, tannery, pharmacy and environmental protection usages, among others.

Further modifications will occur to those skilled in this art and such are considered to fall within the spirit and scope of the invention as defined in the appended claims.

We claim:

1. In a canned or sealed centrifugal motor pump for pumping fluid from an inlet to an outlet and having a pump housing containing a fluid impeller and a motor having a coaxially mounted stator and an inner hollow rotor, the combination of an inner shaft passing axially through the rotor and mounting the same by upper and lower ball-bearing means disposed in chambers within the upper and lower ends of the hollow rotor, the rotor being closed at its lower end adjacent said impeller and open at its upper end; and an inverted cup closing the top of the stator, centrally mounting said shaft and enclosing the upper end of the rotor; means for filling the chambers of the ball-bearing means with lubricant; means for pumping a portion of the pumped fluid between the stator and rotor to cool the same and for returning such fluid portion back to the inlet of the pump; and means for producing an air-cushion seal within said cup and between the stator and rotor for preventing the fluid from entering the chambers containing the ball-bearing means at the ends of the hollow rotor and thereby isolating the ball bearing means from such fluid.

2. Apparatus as claimed in claim 1 and in which means is provided within the said shaft for circulating coolant to cool the said ball-bearing means and lubricant.

3. Apparatus as claimed in claim 2 and in which the coolantproviding means comprises tube means carried within said shaft.

4. Apparatus as claimed in claim 3 and in which said tube means comprises coaxial tubes extending along said shaft, entering and exiting coolant at different points external of said cup.

5. Apparatus as claimed in claim 4 and in which means is provided for filling said chambers with lubricant comprising a further tube extending along said shaft coaxial with the coaxial tubes.

6. Apparatus as claimed in claim 1 and in which means is provided for filling said chambers containing the ball bearing means with lubricant and comprising a tube running within said shaft.

7. Apparatus as claimed in claim 1 and in which means is provided for controlling the pressure of said air-cushion seal.

8. Apparatus as claimed in claim 7 and in which said pressure-controlling means operates through a tube carried from atmosphere and/or pressure-regulating means along said shaft and communicating with the hollow rotor.

9. Apparatus as claimed in claim 1 and in which the upper chamber containing said ball-bearing means is provided with sealing means disposed between one or both of the shaft and the inner surface of the said cup.

10. Apparatus as claimed in claim 9 and in which said sealing means comprises spiral seals.

11. Apparatus as claimed in claim 1 and in which sealing means is provided between the pump and the chamber of the motor stator, and throttle aperture means is provided in the region thereof.

12. In a canned or sealed centrifugal motor pump for pumping fluid from an inlet to an outlet having a pump housing containing a fluid impeller and a motor having a coaxially mounted stator and an inner hollow rotor, the combination of an inner shaft passing axially through the rotor and mounting the same by upper and lower ball-bearing means disposed in chambers within the upper and lower ends of the hollow rotor, the rotor being closed at its lower end adjacent said impeller and open at its upper end; an inverted cup closing the top of the stator, centrally mounting said shaft and enclosing the upper end of the rotor; means for pumping a portion of the pumped fluid between the stator and rotor to cool the same and for returning such fluid portion back to the inlet of the pump; and means for producing an air-cushion seal within said cup and between the stator and rotor for preventing the fluid from entering the chambers containing the ball-bearing means at the end of the hollow rotor and thereby isolating the ball bearing means from such fluid.

13. In a canned fluid delivery motor pump including a pump casing containing a pump impeller, a motor stator and a hollow rotor, a pump sealing ring between the impeller and its pump suction inlet and the chamber of the stator, and in which means comprising non-magnetic corrosion-resistant metallic shield-cans are provided isolating the stator and rotor from the delivered fluid medium, the combination of a cup mounted inverted on the upper end of the stator on top of the hollow rotor by a coaxial three-tube vertical shaft; the said hollow rotor comprising an open upper end chamber and a lower closed end chamber each containing ball bearings mounted between said shaft and the inner rotor walls at such ends; the said vertical shaft comprising three successive coaxial tubes, with the upper end of the innermost tube being connected with the outside atmosphere and its lower end connected with the lower bearing chamber; the middle tube of said three tubes and the outer tube being connected with water inlet and outlets, respectively; at least one throttle aperture disposed between the said sealing ring of the pump and the said motor stator chamber; a flowreturning tube provided between the outer surface of the cup and the said suction inlet of the pump; a spiral seal between the inner surface of the ball-bearing chamber of the hollow rotor and the said vertical shaft; and a spiral seal between the outer surface of the upper ball-bearing chamber of the hollow rotor and the inner surface of the cup.

* * * * *